US005183448A

United States Patent [19]

Wang

[11] Patent Number: 5,183,448

[45] Date of Patent: Feb. 2, 1993

[54] FOOT TRAINING MACHINE

[75] Inventor: Leao Wang, Taichung Hsien, Taiwan

[73] Assignee: Greenmaster Industrial Corp., Hsien, Taiwan

[21] Appl. No.: 736,584

[22] Filed: Jul. 26, 1991

[51] Int. Cl.[5] ..... A63B 22/04

[52] U.S. Cl. ..... 482/52; 482/139; 482/92

[58] Field of Search ..... 272/70, 130, 69, 93, 272/94, 132, 134, DIG. 9; 482/52, 53, 79, 92, 139

[56] References Cited

U.S. PATENT DOCUMENTS 4,708,338 11/1987 Potts ..... 272/70
4,720,093 1/1988 Delmar ..... 272/70
4,846,458 7/1989 Potts ..... 272/130
4,949,993 8/1990 Stark ..... 272/70
4,989,858 2/1991 Young ..... 272/70
5,033,733 7/1991 Findlay ..... 272/70
5,040,786 8/1991 Jou ..... 272/70

*Primary Examiner*—Stephen R. Crow
*Assistant Examiner*—Jerome Donnelly
*Attorney, Agent, or Firm*—Bacon & Thomas

[57] ABSTRACT

A foot training machine having two pedal assemblies the topmost edge of each of which being constantly maintained at the horizontal position for smooth stepping. The pedal of each pedal assembly has two opposite ends pivoted to two rocker arms which are equal in length. The two opposite ends of the two rocker arms are respectively pivoted to two shaft tubes spaced on the base of the machine. The two rocker arms are freely rotated on the two shaft tubes permitting the pedal to be constantly maintained at the horizontal position while stepping.

7 Claims, 5 Drawing Sheets

FOOT TRAINING MACHINE

BACKGROUND OF THE INVENTION

1. Field of the Invention

The present invention relates to foot training machines and relates more particularly to a foot training machine the pedals of which can be constantly maintained in the horizontal position during stepping.

2. Description of the Prior Art

Because of technique problems or in order to reduce manufacturing cost, the two pedals in a foot training stepper machine are generally controlled by two hydraulic cylinders to alternatively move up and down at one end (see FIG. 1). Because the pedals are alternatively stepped upon to rotate at one end, they can not be constantly maintained at the horizontal position for positive stepping. While stepping, the ankle may be hurt easily. Further, the two pedals are compulsorily alternatively moved up and down during stepping, i.e., the right leg must be lifted when the left leg is stepping down. Therefore, the muscles on each leg are stretched only when the leg is stepping down. This arrangement reduces the effect of the exercise.

SUMMARY OF THE INVENTION

The present invention has been accomplished to eliminate the aforesaid problems. It is therefore the main object of the present invention to provide a foot training machine in which the two pedals are constantly maintained at the horizontal position. It is another object of the present invention to provide a foot training machine which is effective in training the muscles of the legs.

DETAILED DESCRIPTION OF THE PREFERRED EMBODIMENT

Figure 1:
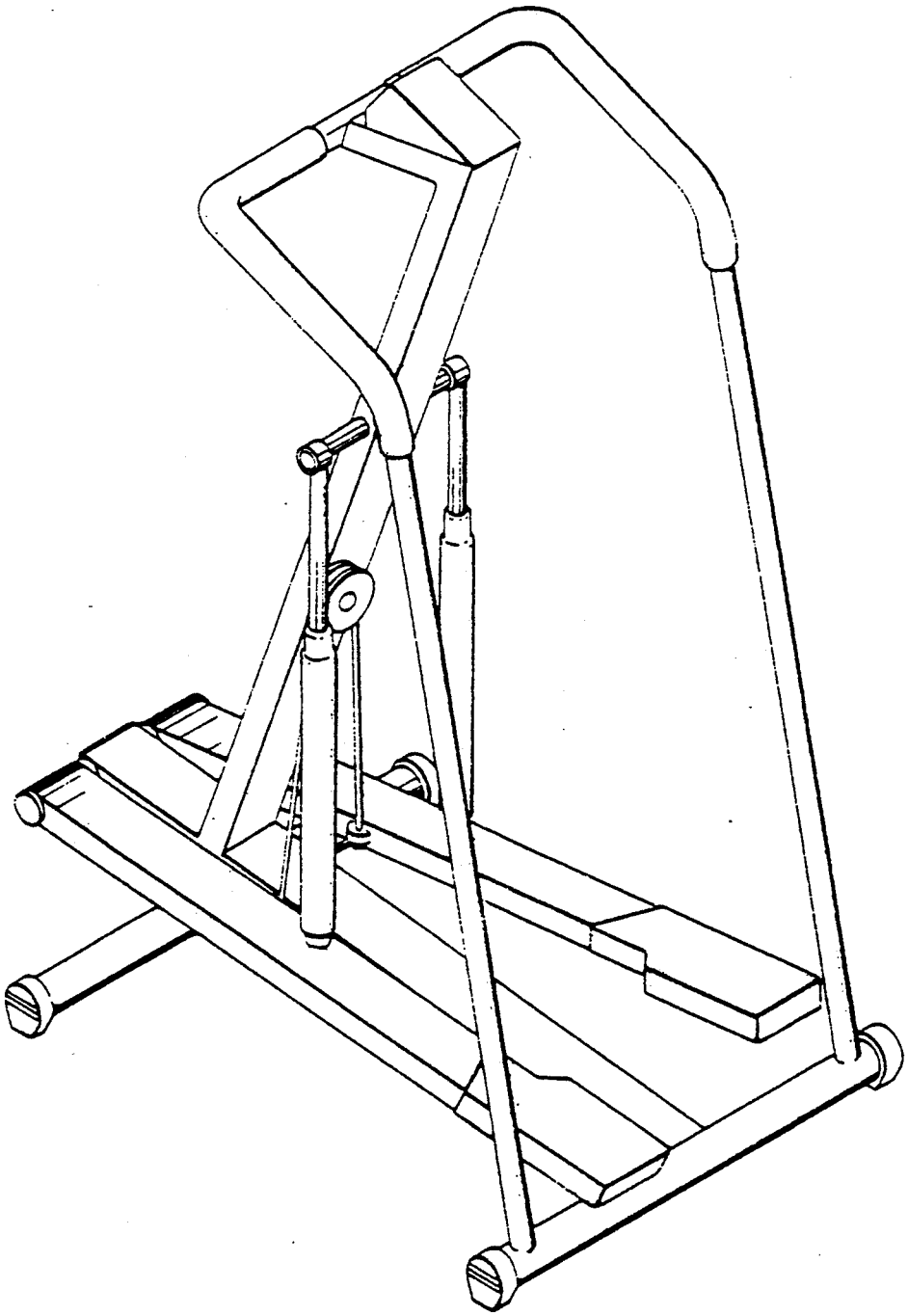
FIG. 1 is a perspective view of a foot training machine according to the prior art.
Figure 2:
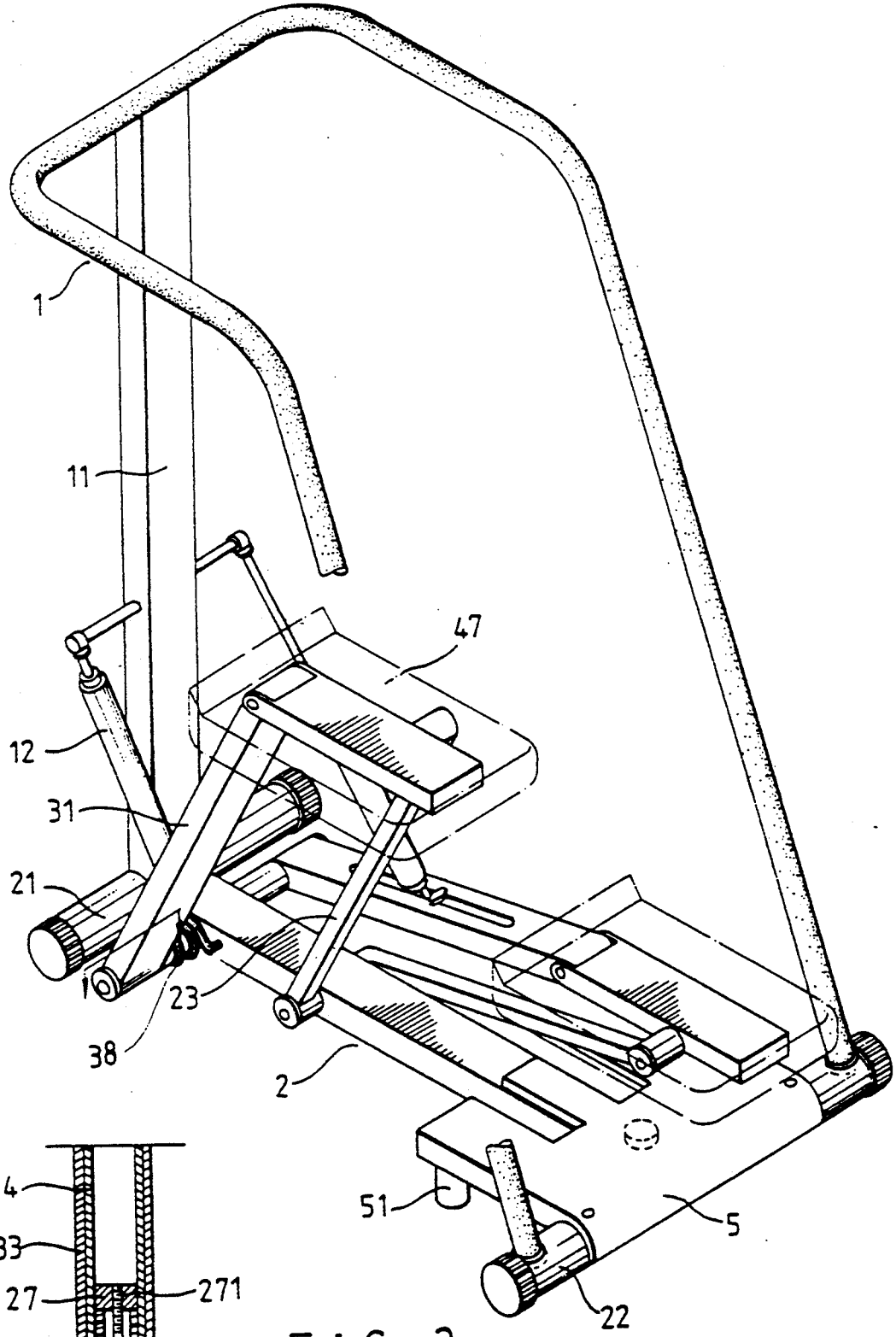
FIG. 2 illustrates a foot training machine constructed according to the present invention.
Figure 3:
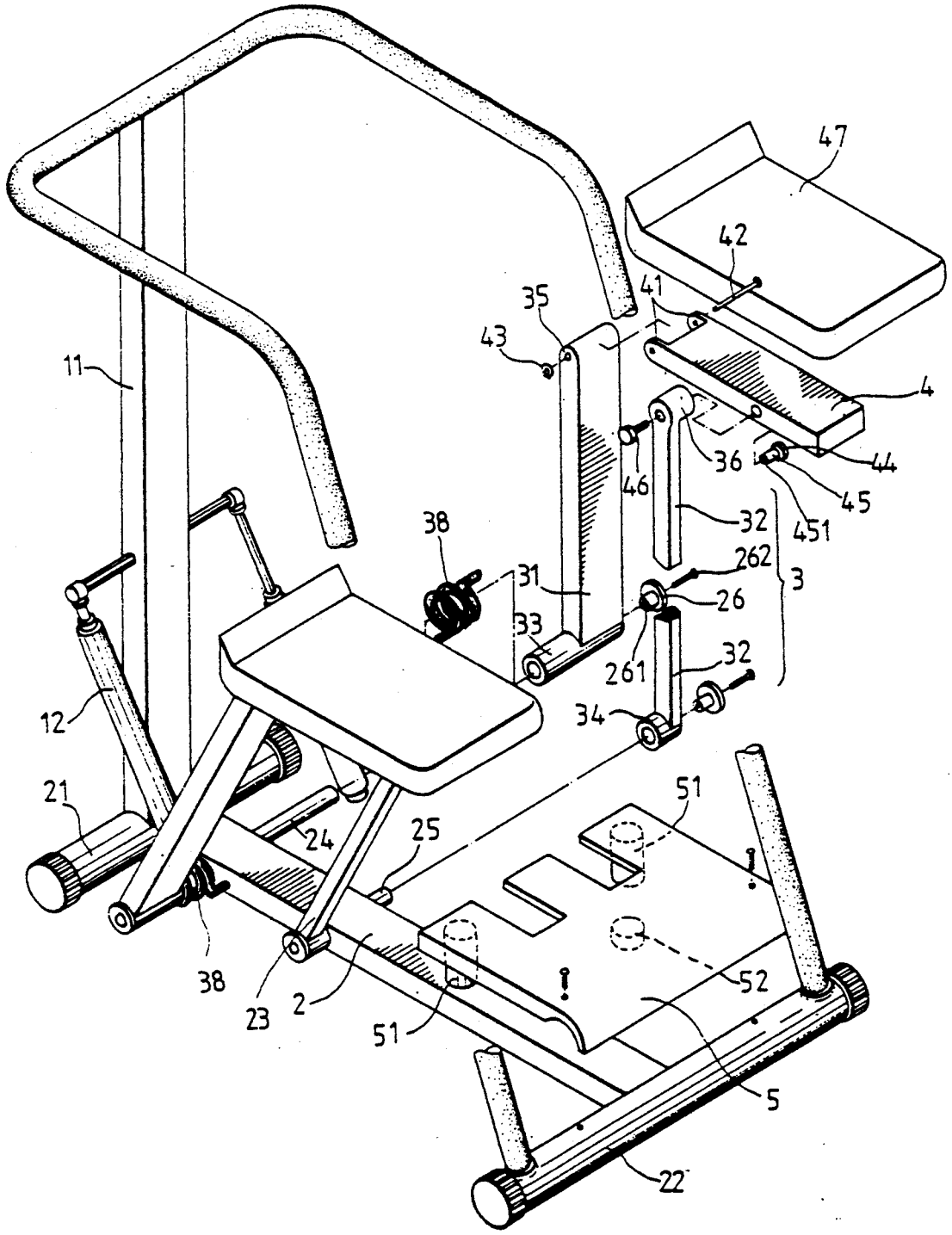
FIG. 3 is an exploded perspective view of the present invention.

Referring to FIGS. 2 and 3, there is a base 2 mounted on a main frame 1 at the bottom, which comprises a front base bar 21 and a rear base bar 22 disposed in parallel with each other at two opposite ends, a connecting bar 23 connected between said front and rear base bars 21 and 22 at a right angle, and two spaced shaft tubes 24 and 25 transversely fastened in said connecting bar 23 at suitable locations.

Figure 2A:
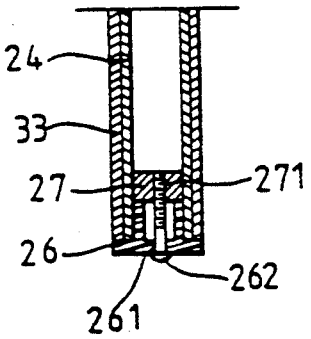
FIG. 2*a* is a partial cross-sectional view of a portion of the foot training machine according to the present invention.

Two rocker arm assemblies 3 are respectively attached to the connecting bar 23 of the base 2 at two opposite sides. Each rocker arm assembly 3 comprises a first rocker arm 31 in L-shape at the front and a second rocker arm 32 at the back. The first and second rocker arms 31 and 32 each has a respective axle sleeve 33, 34 at one end respectively rotatably mounted on the shaft tube 24, 25 at either end and secured in place by a cap 26, which has a through-hole 261 through the central axis thereof, and a screw 262. The shaft tube 24 or 25 has a locating block 27 fixedly set therein, (see FIG. 2*a*) which locating block 27 has a bolt hole 271 at the center. By fastening the screw 262 through the through-hole 261 on the cap 26 into the bolt hole 271 on the locating block 27, the axle sleeves 33, 34 of the rocker arms 31, 32 is rotatably secured to the shaft tube 24, 25 respectively. The rocker arms 31 and 32 further comprises respective thimbles 35 and 36 at an opposite end for holding a pedal 4 therebetween. The pedal 4 has a pair of lugs 41 bilaterally disposed at one end and attached to the thimble 35 on the first rocker arm 31 by a pin 42 and a clamp 43. Therefore, the pedal 4 can be rotated on the thimble 35 of the first rocker arm 31. The pedal 4 further comprises a through-hole 44 spaced from the lugs 41 and disposed in transverse direction for inserting a shaft lever 45. The shaft lever 45 has a bolt hole 451 on the end edge thereof which is inserted into the thimble 36 on the second rocker arm 32 and secured therein by a screw 46.

The first and second rocker arms 31 and 32 are equal in length and the range between the pivoted ends thereof to the pedal 4 is equal to the range between the two shaft tubes 24 and 25 on the connecting bar 23 at either side. Therefore, the pedal 4 is constantly maintained in the horizontal position while pedaling.

Each rocker arm assembly 3 is automatically lifted by a hydraulic cylinder 12, which is fastened in a front post 11 on the main frame 1 at either side, once stepping pressure is released therefrom. On each axle sleeve 33, 34 of each rocker arm 31, 32, there is provided a torsional spring 38 matching with the operation of the hydraulic cylinder 12 to lift the corresponding rocker arm assembly 3 (i.e. the corresponding pedal 4) smoothly, which spring 38 has one end fastened in the base 2 and an opposite end fastened in the rocker arm 31 or 32.

As indicated, the first rocker arm 31 is made in L-shape while the second rocker arm 32 includes an oppositely extending axle sleeve 34 and thimble 36 arrangement at its ends. The axle sleeve 33 projects from the first rocker arm 31 at an inner side and is made in length wider than the width of the first rocker arm 31. The length of the projecting part of the axle sleeve 33 of the first rocker arm 31 is wider than the total length of the axle sleeve 34 and the thimble 36 of the second rocker arm 32. Therefore, the first and second rocker arms 31 and 32 will not obstruct each other and can be freely rotated on the shaft tubes 24 and 25.

Figure 4:
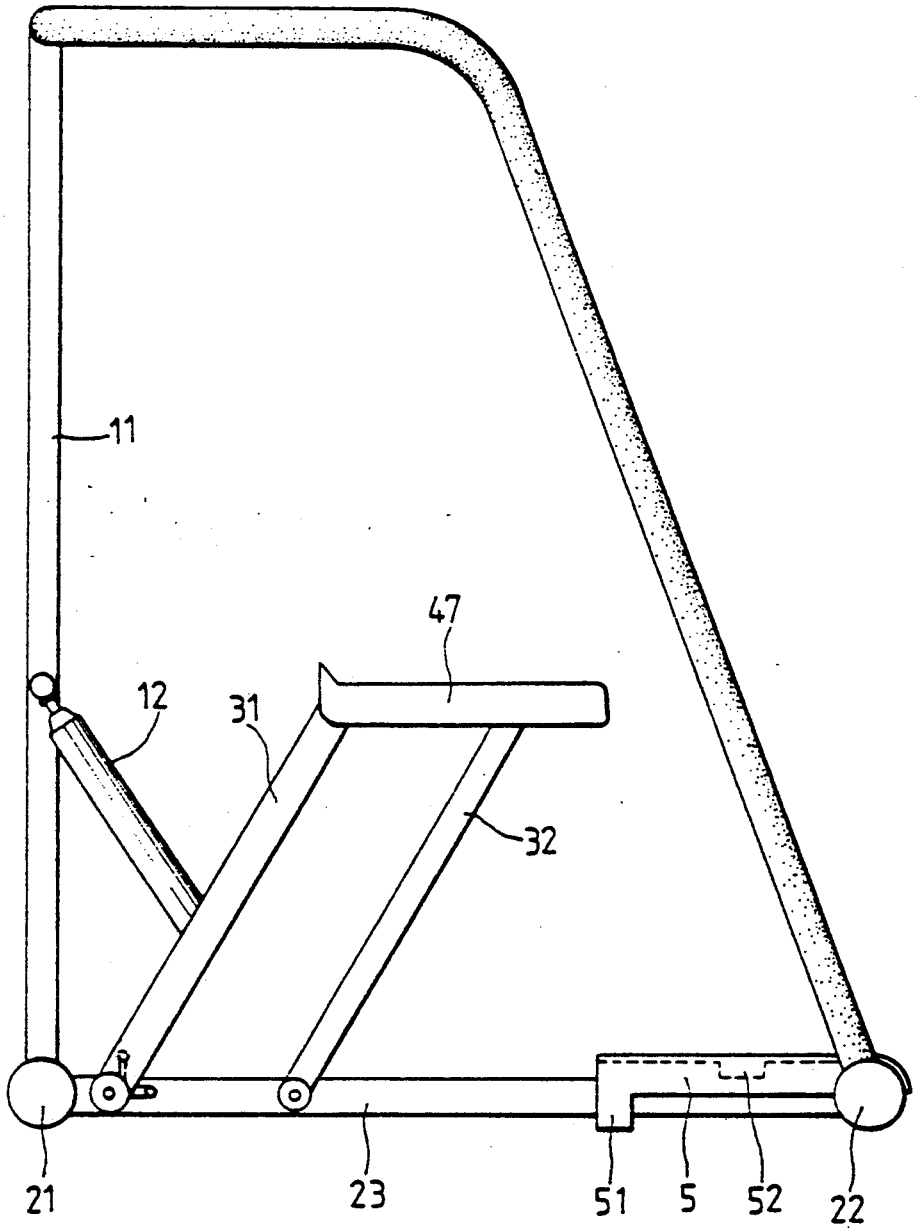
FIG. 4 is a side elevational view of the foot training machine of FIG. 2.

The pedal 4 on each rocker arm assembly 3 is covered with a rubber pad 47 for comfortable and positive stepping. When the machine is not in use, or there is no pressure applied to the rubber pad 47, the rubber pad 47 is disposed at the upper limit position as shown in FIG. 4. While stepping on the rubber pad 47 (pedal 4) on each rocker arm assembly 3, the pressure is partly absorbed through the rocker arms 31 and 32, and the corresponding hydraulic cylinder 12 bears less instantaneous force, and therefore, the service life of the hydraulic cylinder 12 is greatly extended.

There is also provided a rectangular foot plate 5 mounted on the base 2. The foot plate 5 has two stands 51 bilaterally extending from the bottom edge thereof at the front and a cushion 52 projecting from the bottom edge thereof at the middle. The rear end of the foot plate 5 is made in an arched shape curved downwards. During installation, the curved rear end of the foot plate 5 is mounted over the rear base bar 22 of the base 2 with the cushion 52 stopped against the connecting bar 23 and with the two stands 51 stopped against the ground on which the machine is placed.

Figure 5:
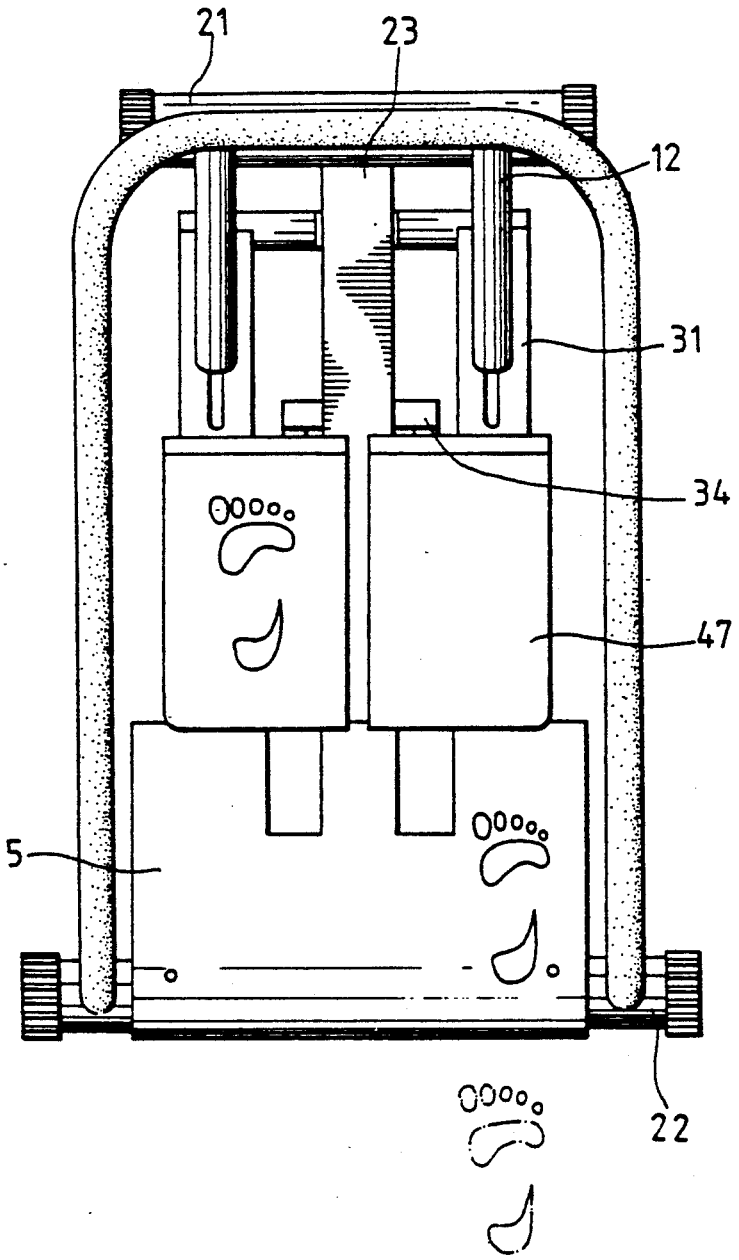
FIG. 5 is a top view of the foot training machine of FIG. 2.

Referring to FIG. 5, the foot plate 5 is provided for a player to stand thereon before stepping on the rubber pad 47 (pedal 4) on each rocker arm assembly 3. It enables the player to easily step on the rubber pad 47. If the foot plate 5 is not provided, one shall have to stand behind the rear base bar 22 before stepping on the rubber pad 47 on each rocker arm assembly 3 (as shown in the dotted footprint). Because the distance between the rear base bar 22 and the rubber pad 47 (pedal 4) is quite long, it is inconvenient or dangerous to step on the rubber pad 47 from a place behind the rear base bar 22 directly.

Although described with reference to a preferred embodiment of the invention, it is to be understood that various changes and/or modifications may be made without departing from the spirit or scope of the invention as defined by the following claims.

What is claimed is:

1. A foot training machine comprising:

a base including a laterally extending front bar, a laterally extending rear bar, and a longitudinally extending connecting bar, said front and rear bars being arranged in a substantially parallel, longitudinally spaced relationship, said connecting bar being fixedly secured to and extending between said front and rear bars; and first and second pedal assemblies arranged on opposite sides of said connecting bar for movement between upper and lower operating limit positions during use of said machine, each of said pedal assemblies including: a pedal, a front rocker arm having a first end pivotally connected to said connecting bar and a second end pivotally connected to said pedal, and a rear rocker arm having a first end pivotally connected to said connecting bar and a second end pivotally connected to said pedal, said front and rear rocker arms being substantially equal in length, the distance between the pivotal connections of the front and rear rocker arms to the connecting bar being equal to the distance between the pivotal connections of the front and rear rocker arms to said pedal, the first ends of said front and rear rocker arms being pivotally connected to said connecting bar in a common substantially horizontal plane and the second ends of said front and rear rocker arms being pivotally connected to said pedal in a common substantially horizontal plane such that said pedal is maintained in a substantially horizontal plane throughout its range of movement, the lateral distance between the front rocker arm and said connecting bar being at least greater than the combined lateral distance between the rear rocker arm and said connecting bar and the width of the rear rocker arm such that said pedal can unobstructively move between said upper and lower operating limit positions.

2. The foot training machine of claim 1, further comprising means for biasing said first and second pedal assemblies toward said upper operating limit position.

3. The foot training machine of claim 1, further comprising a front, upstanding post fixedly secured to said base and a fluid actuator pivotally secured between said upstanding post and each pedal assembly.

4. The foot training machine of claim 1, further comprising a foot plate covering at least a portion of said base, said foot plate having first and second stand supports extending from a bottom front portion of said foot plate on opposite sides of said connecting bar, a central cushion projecting from a bottom central portion of said foot plate and engaging said connecting bar, and a curved rear end mounted over said rear bar of said base.

5. The foot training machine of claim 1, further comprising first and second laterally extending pivot shafts fixedly secured at spaced longitudinal positions to said connecting bar, said front and rear rocker arms of each of said pedal assemblies being pivotally mounted to respective ones of said first and second pivot shafts.

6. The foot training machine of claim 5, further including an axle sleeve fixedly secured to one end of each of said front rocker arms, each of said axle sleeves being freely rotatably mounted about said first pivot shaft, said axle sleeves laterally spacing said front rocker arms from said connecting bar.

7. The foot training machine of claim 6, further including an axle sleeve and a thimble fixedly secured to opposite ends of each of said rear rocker arms, said axle sleeves being freely rotatably mounted about said second pivot shaft and said thimbles being pivotally secured to respective ones of said pedals.

* * * * *